United States Patent [19]

Buzzi

[11] 4,311,105

[45] Jan. 19, 1982

[54] SEWING MACHINE

[76] Inventor: Riccardo Buzzi, Via 5 Maggio No. 19, Milano, Italy

[21] Appl. No.: 4,290

[22] Filed: Jan. 17, 1979

[30] Foreign Application Priority Data

Jan. 30, 1978 [IT] Italy ..... 19765 A/78
Dec. 22, 1978 [IT] Italy ..... 31215 A/78

[51] Int. Cl.[3] ..... D05B 1/06
[52] U.S. Cl. ..... 112/199; 112/315
[58] Field of Search ..... 112/199, 200, 202, 197, 112/314, 315, 165, 166

[56] References Cited

U.S. PATENT DOCUMENTS

| | | | |
|---|---|---|---|
| 924,903 | 6/1909 | Hemleb | 112/199 |
| 3,952,674 | 4/1976 | Hirayama | 112/199 |
| 4,022,140 | 5/1977 | Lienemann | 112/199 |

FOREIGN PATENT DOCUMENTS

| | | | |
|---|---|---|---|
| 1660963 | 2/1971 | Fed. Rep. of Germany | 112/199 |
| 2156316 | 6/1972 | Fed. Rep. of Germany | 112/199 |

*Primary Examiner*—H. Hampton Hunter
*Attorney, Agent, or Firm*—Kirschstein, Kirschstein, Ottinger & Cobrin

[57] ABSTRACT

An actuating mechanism is proposed for the hook and feed dog in a portable sewing machine of the type employed for sewing bags of jute, paper, and the like. In the proposed mechanism, a single cam determines both the compound movement of the hook, which is spring loaded against the cam and provided with at least one ball for reducing the frictional resistance, and of the feed dog by means of a connecting rod journalled at one end to a vertically adjustable support such as to allow the length of the seam stitch to be varied.

6 Claims, 16 Drawing Figures

Fig.10
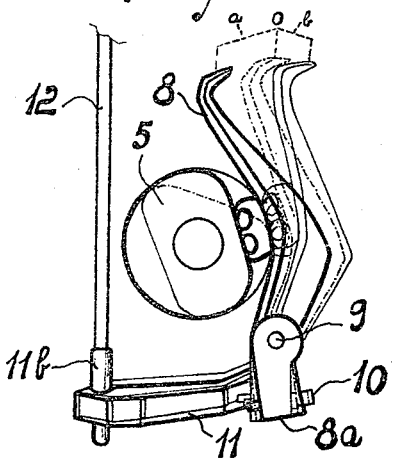
Fig.11
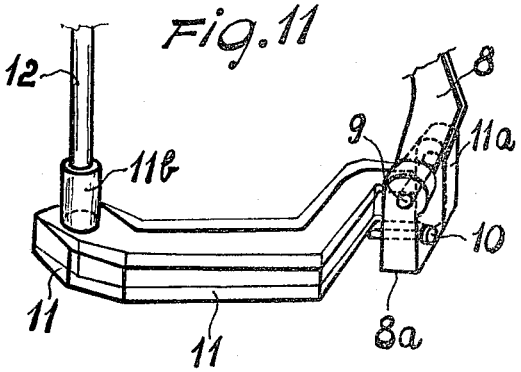
Fig.12
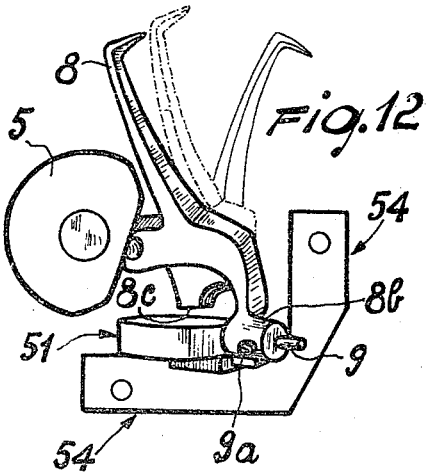
Fig.13
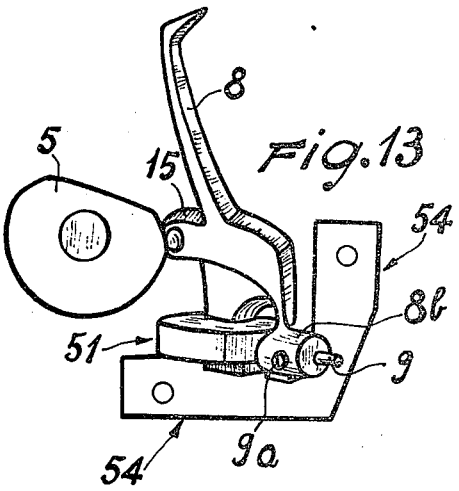
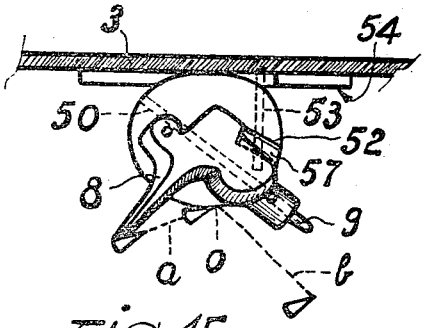
Fig.15
Fig.14
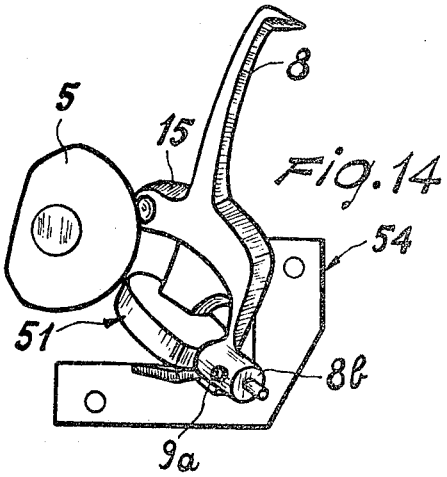

SEWING MACHINE

This invention relates to a mechanism for actuating the hook and feed dog in a portable sewing machine.

Portable sewing machines include, located below their needle plates, means adapted for actuating the hook, the latter being active, in cooperation with the sewing machine needle, to form the knots of a chain stitch.

Such sewing machines further comprise means adapted for imparting a reciprocating motion to the feed dog for the purpose of advancing the material being sewn.

These prior art mechanical means generally comprise two cams, one of which cams imparts to the hook an oscillatory or swinging movement in a first direction, whereas the second cam imparts to the hook a successive swinging movement in a lateral or sideward direction.

A drawback of such prior art mechanisms resides in that for the hook movements, two rotating cams must be provided which require an accurate mutual setting in order to ensure a correct operation of the hook.

Furthermore, limitations are imposed on the movement speed of the hook, which prevents higher sewing rates from being attained. Moreover, prior art machines exhibit the disadvantage of generating an appreciable operating noise level, as well as of being considerably heavy, thereby they are not so convenient to operate.

Also disadvantageous in conventional sewing machines is the fact that the feed dog performs a movement following a circular path having a much reduced radius, thereby the feed dog moves appreciably outwards from the resting surface for the material being sewn, while the length of the individual stitches is very small.

In addition, with prior art sewing machines, it is not possible to vary the length of the individual stitches, which reflects in the impossibility of adjusting the same to suit different sewing requisites.

This invention sets out to provide a portable sewing machine which, while exhibiting none of the above mentioned disadvantages affecting the prior art, involves a reduced number of mechanical components, and has accordingly a lower weight than the prior art machines, and moreover affords sewing capabilities at very high feeding speeds, e.g. of up to 20 meters per minute.

Furthermore, the sewing machine according to this invention permits the stitch length to be varied.

The inventive sewing machine has the added advantages of minimizing the assembling and setting operations, and of enabling the hook to be disassembled along with its actuating means, without requiring the use of tools.

Based upon a conventional type of actuating mechanism for the hook and feed dog of a portable sewing machine, a sewing needle, a feed dog for advancing the material to be sewn, a motor for driving the hook and needle actuating means, the above-mentioned objects are achieved in that said sewing machine comprises a cam attached to the shaft of the driving motor, said cam, on one side, cooperating through its curvilinear profile with a spring loaded hook, carried for oscillation on first and second axes angularly arranged to each other, and on the other side, being journalled to a connecting rod, in turn journalled at a first point to an adjustable support and at a second point to the feed dog, said feed dog being carried on oscillating supports accommodated in the sewing machine case.

Advantageously, according to the invention, the hook oscillates about a first horizontal axis for completing a first portion of its path, and subsequently about a second axis extending at an angle to the first, e.g. vertically, or arranged substantially cross-like with respect to the first, or virtually co-planar therewith, for completing a second portion of the path at an angle with the first portion.

According to the invention, a first embodiment, in which the two axes are arranged one horizontally and the other vertically, comprises means for adjusting the oscillation extent of the hook about the two oscillation axes. Of special advantage is that the contact between the curvilinear profile of the cam and the hook occurs through at least one intervening rolling means, e.g. a ball, accommodated in an embossment of the hook. If desired, two such balls may be provided.

The invention provides for the hook to be advantageously maintained in constant contact engagement with the curvilinear profile of the cam by a spring.

Advantageously, moreover, in accordance with this invention, the cam cooperates with an articulated linkage for concurrently actuating the feed dog, one end of said linkage being carried on an adjustable support which can be moved in a vertical direction within a slot formed in the sewing machine case for the purpose of enabling adjustment of the stitch length. The proposed linkage further affords modification of the circular path of the feed dog into a compound one: ovoidal along the top half of the path, and flat or rectilinear along the bottom half. This pattern allows the length of the stitches to be considerably increased while reducing the bulk below the needle plate.

Furthermore, and in accordance with this invention, to provide a reliable support for the rear side of the feed dog, a linkage is associated with the same at the rear and maintains a correct horizontal balance of the feed dog at any position on the path of the latter and eliminates frictional resistance from the sliding movement.

Further features, advantages and details of the actuating mechanism for the hook and feed dog of a portable sewing machine, according to the invention, will be more clearly understood by making reference to the following description of two preferred embodiments of the same, illustrated by way of example only in the accompanying drawings, where:

Figure 9:
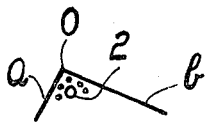

FIGS. 8*a* and 8*b* are perspective views of the hook and its support members, at different movement stages;

FIG. 9 shows schematically the angled path of the hook tip around the needle of the sewing machine.

FIG. 10 is a perspective view of the hook of the first embodiment at three positions, i.e. in full thick lines at the starting position, in full fine lines at the position O of deflection and in chain lines at the end of the second path portion b;

FIG. 11 is a perspective view on larger scale of the support of FIG. 10 showing the shape thereof;

FIGS. 12, 13 and 14 are perspective views of the hook of the second embodiment at the starting position, of the position O of deflection and at the end of the second path portion b respectively, whereby FIG. 12 shows with fine lines and with chain lines the positions of the hook illustrated in FIGS. 13 and 14 respectively; and FIG. 15 is a top view on FIG. 12 showing the three position of the hook tip and with chain lines the two paths a and b of the compound movement thereof.

Figure 1:
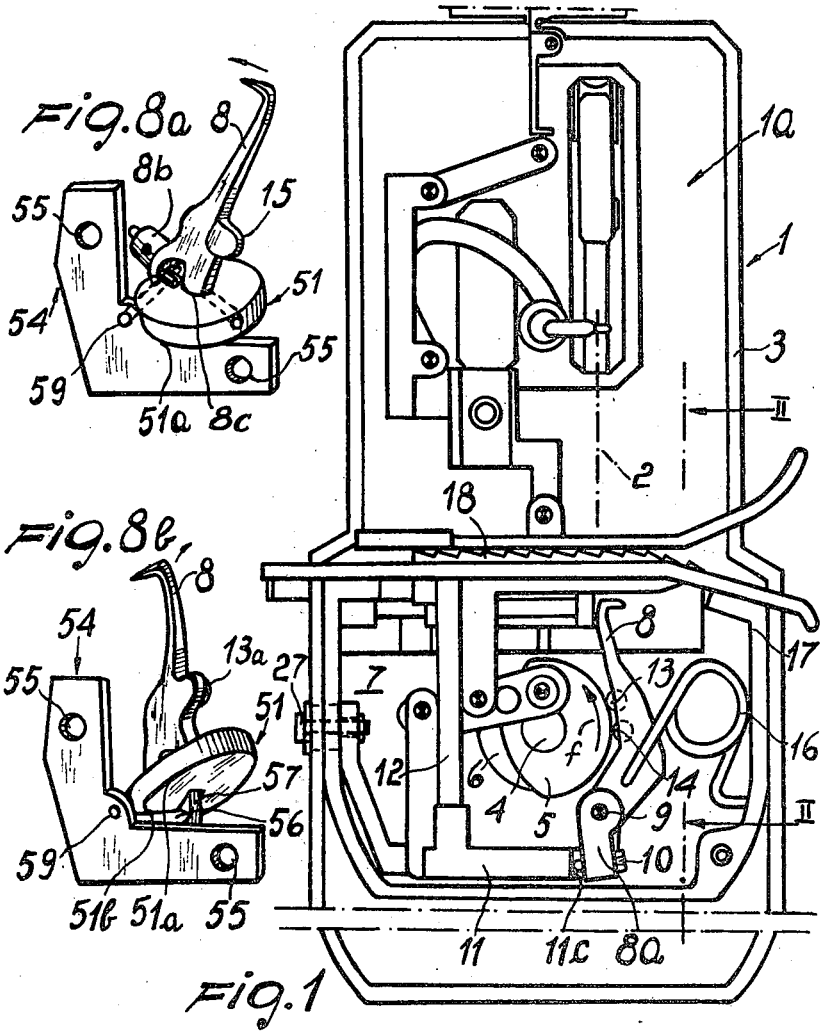
FIG. 1 shows a first embodiment of the actuating mechanism for the hook and feed dog of a portable sewing machine, in a front view with the front cover removed evidencing those elements which are essential to illustrate the invention.
Figure 2:
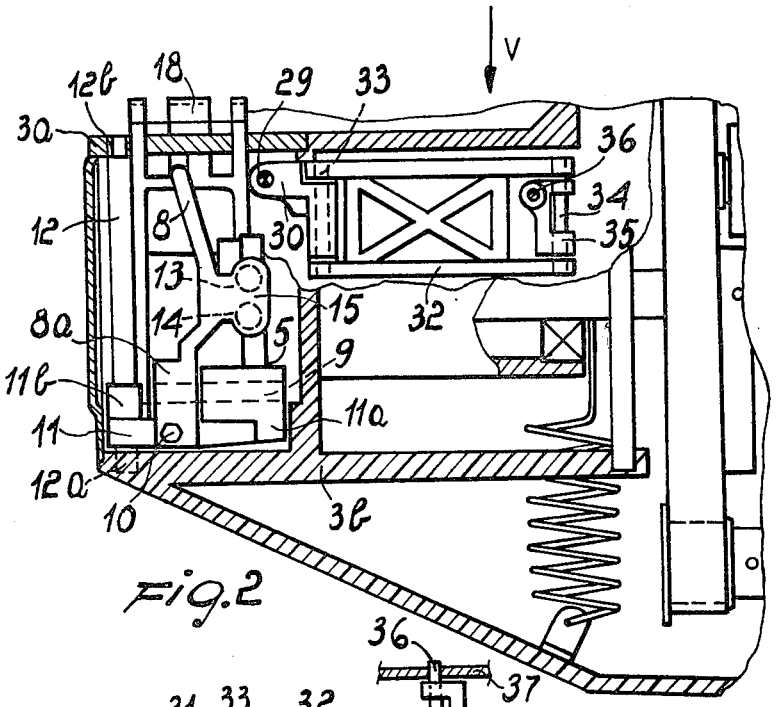
FIG. 2 is a detail view, partly sectional, of the sewing machine, taken along the line II—II of FIG. 1.

FIG. 1 shows schematically a front view of a portable sewing machine 1, which in its top portion includes a unit or assembly 1*a* for actuating the sewing needle, schematically indicated at 2. For this purpose, at the rear of the shrouding case or housing 3 of the sewing machine, a driving motor (not shown) is provided which also serves for driving, through its output shaft 4, a cam 5 rotating in the direction of the arrow f. The shaft 4 is carried by a bearing 6 accommodated in a vertical wall 7 of the case 3 of the sewing machine. The cam 5 cooperates, through its curvilinear peripheral profile, with a hook 8 which, in cooperation with the needle 2, so arranges the yarn as to form chain stitches. In this first embodiment, the hook 8 is enabled to perform an oscillatory movement about a pin 9 defining a first horizontal axis, as will be explained further below. An adjusting screw 10, mounted on the hook 8 and protruding from it, enables the oscillation of the hook 8 about said pin 9 to be adjusted. The pin 9 is accommodated in a lug 11*a* of a supporting member 11, which further comprises a sleeve projection 11*b* receiving a vertical shaft 12 pivotally carried in suitable seats 12*a*, 12*b*, provided in horizontal walls 3*a* and 3*b* of the case 3 (FIG. 2). Thus, the supporting member 11 is enabled to oscillate about a second vertical axis defined by said shaft 12. The supporting member 11 further includes an abutment side 11*c* (FIGS. 1 and 11), which engages the free end of the screw 10. Thus, the screw 10 and abutment 11*c* define means for limiting pivotal movement of the hook 8 with respect to the supporting member 11 about the first horizontal axis.

The movement of the cam 5 is transmitted to the hook 8 with the interposition, in the example considered, of two balls, 13 and 14, accommodated in seats of a lug 15 projecting on one side of the hook 8 in a direction substantially parallel to said first axis (FIG. 2). Through a resilient means in form of a spring 16 intervening between the case 3 and hook 8, the latter is constantly pushed against the curvilinear peripheral profile of the cam 5.

On the hook 8, the numeral 8*a* denotes an embossment accommodating the cited horizontal pin 9. Furthermore, in FIG. 1, there is indicated at 17 a hook enclosing case, also enclosing the actuating mechanism for the feed dog 18 which will be described in a more detailed manner hereinbelow with reference to FIGS. 3 to 5.

Figure 5:
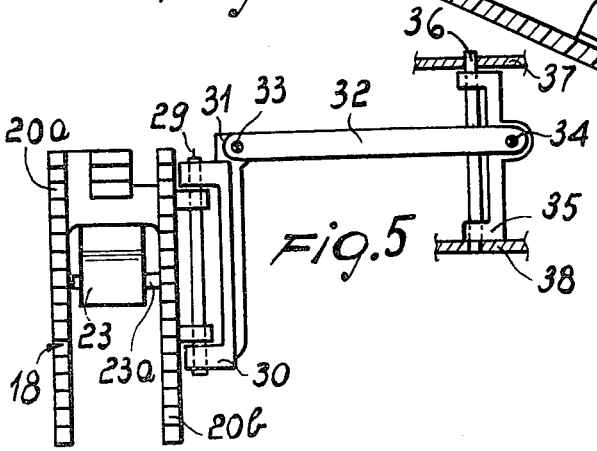
FIG. 5 is a schematical plan view of the feed dog guiding and supporting mechanism.
Figure 3:
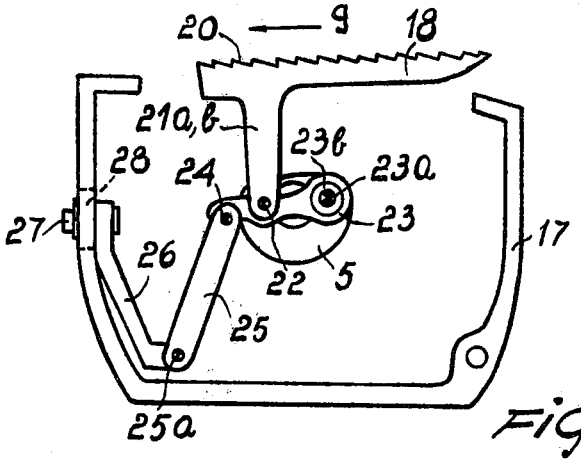
FIGS. 3 and 4 illustrate schematically the feed dog actuating mechanism, in front views and in two different operative positions.
Figure 4:
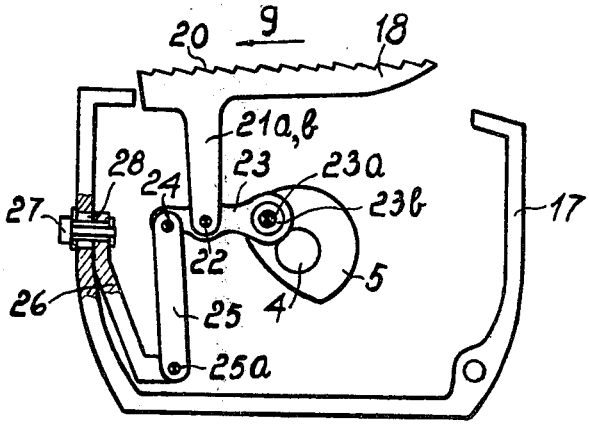
Figure 6:
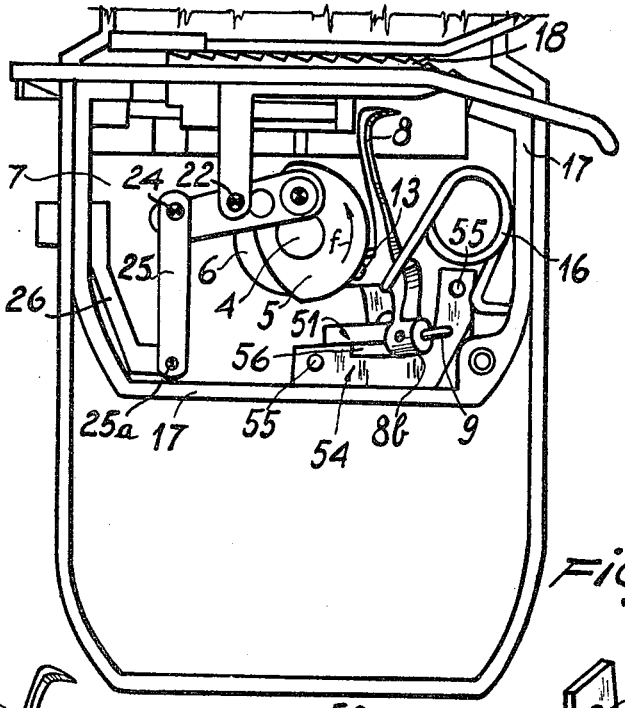
FIG. 6 shows the bottom or lower portion of a second embodiment of the hook and related support according to the invention, with the front cover removed as in FIG. 1.

For clarity of illustration, such FIGS. 3–5 only show those elements which affect the actuation of the feed dog 18. The latter has a conventional serration 20 at the top for advancing the material to be sewn, not shown, in the direction of the arrow g. The feed dog 18 comprises two parallel bars 20*a* and 20*b* (FIG. 5), which have integral arms 21*a*, 21*b*, respectively projecting downwards and configurated as a fork. The arms 21*a*, 21*b* are journalled at the bottom, at 22, to an intermediate point of a connecting rod 23 in turn journalled with one end to the cam 5 by means of a pivot pin 23*a* eccentrically arranged on the cam. Advantageously a bushing 23*b* is provided between the pin 23*a* and the one end of the rod 23. The free end of the connecting rod 23 is journalled at 24 to one end of a connecting lever 25, which, at its other end, is journalled at 25*a* to one end of an oblique supporting arm 26. The latter is secured at the top, at its other end, by means of a screw 27, which penetrates a slot 28 formed through the wall of the case 17, or of the case 3. It thus becomes possible, by previous loosening of the screw 27, to shift the arm 26 vertically and vary the radius of the path followed by the pivot pin 22 to achieve the previously cited compound path of the feed dog 18. Thus, one is able to adjust as desired the length of the stitches.

From FIG. 5, showing the support means of the feed dog in a plan view in the direction of the arrow V of FIG. 2, it may be seen that the feed dog 18 is connected at the rear, with the interposition of a substantially horizontal shaft 29, to a first support 30 of C-like shape. Said support 30 is journalled, with a side lug 31 thereof, to one end of supporting arm 32 by means of a substantially vertical pivot pin 33. The supporting arm 32 is journalled, at its other end, by means of a substantially vertical pin 34, to a further C-like support 35, which is carried by a substantially horizontal through shaft 36 accommodated in vertical walls 37,38 of the case of the sewing machine.

The second embodiment of the support for the hook 8 will be described next.

Figure 7:
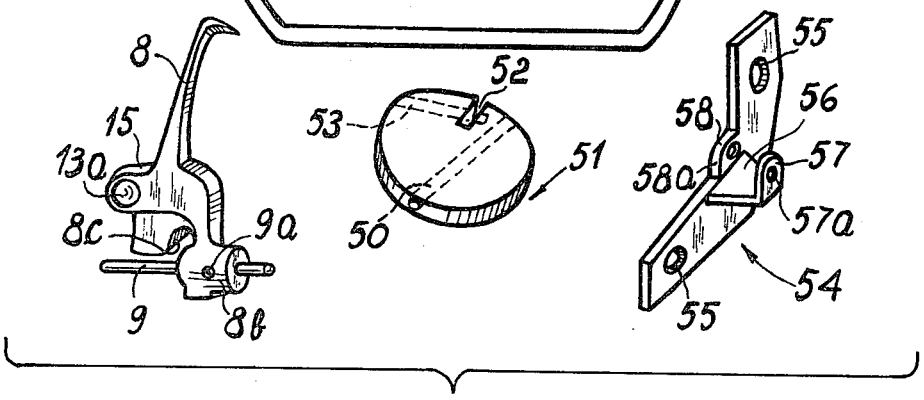
FIG. 7 is an exploded view of the same hook and support parts as shown in FIG. 6.

As graphically evidenced in FIG. 7, the hook 8 has a lug 15 accommodating a single ball 13*a*, the hook 8 being also provided with an eye 8*b* receiving a pin 9 which can be secured to the eye 8*b* by means of a securing screw 9*a*. The hook 8 is journalled with its pin 9 in a through bore 50 of a disk-like movable supporting member 51, e.g. of ellipsoidal configuration, the same further having a recess or cavity 52 and a bore 53 formed, similar to the bore 50, through the disk-like member 51 within the thickness dimension thereof i.e. substantially parallel to the two opposite flat faces of the disk. The through bores 50 and 53 form an angle therebetween. There is indicated at 54 a fixed support which can be attached to the case 3 by means of screws, not shown, penetrating slots 55. The fixed support 54 has an arm 56 provided with an end lug 57, through the latter and an opposite lug 58 of the support 54, coaxial bores 57*a*, 58*a* being provided. The movable supporting member 51 is positioned between the lugs 57 and 58, the recess 52 in the same receiving the lug 57. A pivot pin 59 provides for the journalling of the movable supporting member 51 to the stationary support 54. Whereas the two final or limit positions of the oscillation performed by the movable supporting member 51 about pivot pin 59 are determined by abutment of its edges 51*a* and 51*b*, against edges of the fixed support 54, the oscillation of the hook 8 itself with respect to the supporting member 51 is limited by means of its abutment side 8*c* striking the upper flat faces of the supporting member 51. The spring 16, as well as the remaining parts of the mechanism, remain the same, as those described above.

As FIG. 9 shows clearly, the hook 8 performs a reciprocating movement comprising a first path portion a, an intermediate point or position O of deflection, and a second path b, which results in an angled path portion, the hook being thus always ready to catch the yarn, shown by dots in different positions, regardless of the position of the yarn with respect to the needle 2.

The operation of the mechanism according to the invention will be next described.

As the cam 5 rotates in the direction of the arrow f, the hook 8 is caused to perform a first oscillatory movement a about the first horizontal axis defined by pin 9 (FIG. 10). The magnitude of this oscillation can be adjusted by means of the adjusting screw 10. Upon completion of this first oscillation determining the movement a, which is stopped as soon as the screw 10 strikes the abutment side 11*c* of support 11, the hook 8 is further pushed by the curvilinear peripheral profile of the cam 5 to perform, together with its support 11, a further oscillation about the vertical axis defined by shaft 12, which further oscillation causes the hook tip to move along the second path portion b. Same applies to the second embodiment, in which the hook 8 is first caused to pivot about the first axis defined by pin 9 within through bore 50 of supporting member 51, and then caused to pivot together with supporting member 51 about the second axis defined by pin 59 within through bore 53 (FIG. 15).

Thus it becomes possible to achieve with a single cam two oscillatory movements a, b set at an angle to each other, i.e. in two planes forming an angle between each other, for the tip of the hook 8 about the needle 2.

By providing the two balls 13,14 a quicker action of the hook 8 is achieved, since when at the reversal points where inclination of the curvilinear profile of the cam 5 changes one of the balls is no longer in contact with said curvilinear profile of the cam 5, then the other ball is ready to contact said cam, thereby reducing the dead times substantially. The movement of the feed dog 18 for feeding the material to be sewn is clearly visible in FIGS. 3 and 4. By positioning the arm 26 at different heights through actuation of the screw 27, one is enabled to advantageously adjust the length of the stitches.

It should be noted that, since the feed dog 18 is raised in equilibrium during the sewing step, the support of the feed dog itself, as provided through the arms 21*a*, 21*b*, would be inherently inadequate. The oscillating supporting means illustrated in FIG. 5 provide an adequate form of support. Such means (29–36) allow a free movement for the feed dog 18, such as to cause the material to be sewn to be advanced. The feed dog 18, however, is prevented from performing undesired movement, and in particular, the feed dog can be guided accurately by the above-described support means, even at high rotational speeds of the cam 5.

In the second embodiment of the hook support, it can be noted that the same does not require adjusting screws, thereby it is advantageously possible to eliminate the operations of setting each individual machine, which results in a considerable economy of time. Furthermore, with this solution, the operating noise level is also substantially lowered.

In actual practice, the movable support element 51 and the fixed support 54 may have many desired geometrical shapes, while the pivot pins 9 and 59 may be positioned other than substantially cross-like as indicated, it being also possible to replace individual elements with other functionally equivalent elements, without departing from the invention scope.

Thus, with the proposed solutions, the objects mentioned in the preamble are fully achieved, and in particular the ones related to a high sewing speed, e.g. up to 20 meters per minute, the one inherent to an extremely silent operation, the one of a simplification and reduction of the number of components involved, as well as that of an operation that implies conditions of almost no wear.

The dimensions and materials can be selected at will. All of the characteristics which are deducible from the specification, appended claims and accompanying drawings are substantial to the invention, either singly or in any desired combination thereof.

I claim:

1. A sewing machine of the type for making chain stitches, comprising a shrouding case, a sewing needle, a hook co-operating with said needle for making chain stitches, a feed dog for feeding material to be sewn, a driving motor, a shaft rotated by said driving motor, a cam on said shaft, a supporting member for said hook, said supporting member pivotally supporting said hook about a first axis and being pivotally connected to said shrouding case about a second axis forming an angle with said first axis, means for limiting pivotal movement of said hook with respect to said supporting member about said first axis, and resilient means for constantly pushing said hook against said cam: wherein said cam has a peripheral profile for first displacing said hook about said first axis and then displacing said hook together with said supporting member about said second axis and vice versa, whereby said hook performs oscillations in two planes forming an angle between each other.

2. A sewing machine as claimed in claim 1, wherein said hook is supported by said supporting member about a first horizontal axis and said supporting member is pivotally connected to said shrouding case about a second vertical axis, and wherein said means for limiting pivotal movement of said hook with respect to said supporting member about said first axis comprise an abutment on sais supporting member and an adjusting screw on said hook for engagement with said abutment.

3. A sewing machine as claimed in claim 1, wherein said supporting member comprises a disk having through bores therein extending substantially parallel to two opposite flat faces of said disk and defining said first and said second axis, respectively, and wherein the machine further comprises a fixed support having spaced apart lugs for receiving a pivot pin penetrating one of said through bores and defining said second axis, said means for limiting pivotal movement of said hook with respect to said supporting member about said first axis comprising an abutment on said hook engaging a corresponding one of said flat faces of said disk.

4. A sewing machine as claimed in claim 1, wherein said hook has a lug projecting laterally therefrom in a direction substantially parallel to said first axis, said lug defining seats for receiving balls engaging said peripheral profile of said cam.

5. A sew machine as claimed in claim 1, further comprising a connecting rod having one end eccentrically connected to said cam, a connecting lever having one end pivotally connected to another end of said connecting rod, a supporting arm having one end adjustably secured to said shrouding case and another end pivotally connected to another end of said connecting lever, an arm integral with said feed dog and pivotally connected to said connecting rod at a point thereof between said one and said another end thereof, and support means for pivotally supporting said feed dog on said shrouding case.

6. A sewing machine as claimed in claim 5, wherein said support means comprises a first C-like support pivotally connected to said feed dog about a substantially horizontal axis, a supporting arm having one end pivotally connected to said C-like support about a substantially vertical axis, and a further C-like support pivotally connected to another end of said supporting arm about a substantially vertical axis and pivotally supported by said shrouding case about a substantially horizontal axis.

* * * * *